US008947981B2

(12) United States Patent
Fischer et al.

(10) Patent No.: US 8,947,981 B2
(45) Date of Patent: Feb. 3, 2015

(54) ATTENUATING MASS FOR AN ULTRASONIC SENSOR, USE OF EPOXY RESIN

(75) Inventors: Walter Fischer, Mühldorf am Inn (DE); Volker Muhrer, Fürth (DE); Karl-Friedrich Pfeiffer, Erlangen (DE); Manfred Roth, Groβhabersdorf (DE)

(73) Assignee: Continental Automotive GmbH, Hannover (DE)

( * ) Notice: Subject to any disclaimer, the term of this patent is extended or adjusted under 35 U.S.C. 154(b) by 178 days.

(21) Appl. No.: 13/575,905

(22) PCT Filed: Jan. 27, 2011

(86) PCT No.: PCT/EP2011/051146

§ 371 (c)(1),
(2), (4) Date: Jul. 27, 2012

(87) PCT Pub. No.: WO2011/092245

PCT Pub. Date: Aug. 4, 2011

(65) Prior Publication Data

US 2013/0114379 A1 May 9, 2013

(30) Foreign Application Priority Data

Jan. 29, 2010 (DE) ..... 10 2010 006 216
Apr. 9, 2010 (DE) ..... 10 2010 014 319

(51) Int. Cl.
*G10K 11/165* (2006.01)

(52) U.S. Cl.
CPC ..... *G10K 11/165* (2013.01)
USPC ..... 367/189

(58) Field of Classification Search
CPC ..... G10K 11/165
USPC ..... 367/189; 181/207
See application file for complete search history.

(56) References Cited

U.S. PATENT DOCUMENTS

| | | | | |
|---|---|---|---|---|
| 4,381,470 | A | 4/1983 | Leach et al. | |
| 6,467,138 | B1 | 10/2002 | Aimé | |
| 2011/0098383 | A1 | 4/2011 | Albert et al. | |
| 2013/0114379 | A1 * | 5/2013 | Fischer et al. | 367/189 |

FOREIGN PATENT DOCUMENTS

| | | | |
|---|---|---|---|
| CA | 2788422 | A1 * | 8/2011 |
| CN | 101077956 | A | 11/2007 |
| CN | 201060012 | Y | 5/2008 |
| CN | 102714032 | A * | 10/2012 |
| DE | 3431741 | A1 | 3/1986 |

(Continued)

OTHER PUBLICATIONS

International Search Report for PCT/EP2011/051146; mailed Jun. 6, 2011.

(Continued)

*Primary Examiner* — Daniel Pihulic
(74) *Attorney, Agent, or Firm* — Cozen O'Connor

(57) ABSTRACT

Temperature stability at the temperatures prevailing in a motor and stability that is required over an entire temperature range are provided by an attenuating mass. This enables continuous use at temperatures of approximately 150° C. while providing ultrasonic attenuation at low temperatures.

12 Claims, 1 Drawing Sheet

(56) References Cited

FOREIGN PATENT DOCUMENTS

| | | | | |
|---|---|---|---|---|
| DE | 19756577 | C1 | | 8/1999 |
| DE | 102007047013 | A1 | | 4/2009 |
| DE | 102008030904 | A1 | | 12/2009 |
| EP | 2504831 | A1 | * | 10/2012 |
| JP | 62-133900 | | | 6/1987 |
| JP | 63-186794 | | | 8/1988 |
| JP | 05-220767 | | | 8/1993 |
| WO | 2009/047085 | A1 | | 4/2009 |
| WO | WO 2011092245 | A1 | * | 8/2011 |

OTHER PUBLICATIONS

English Translation of Chinese Office Action and Search Report issued Apr. 11, 2013 in corresponding Chinese Application No. 201180007405.2.

* cited by examiner

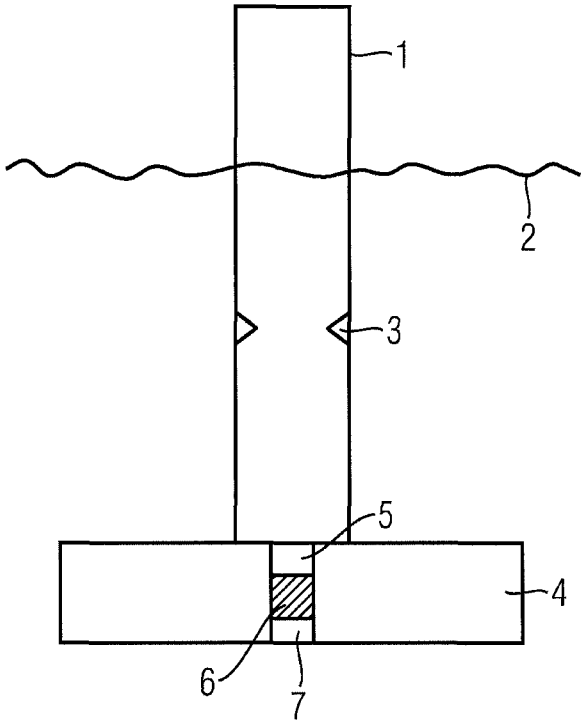
1
2
3
5
4
6
7

ATTENUATING MASS FOR AN ULTRASONIC SENSOR, USE OF EPOXY RESIN

CROSS REFERENCE TO RELATED APPLICATIONS

This application is the U.S. national stage of International Application No. PCT/EP2011/051146, filed Jan. 27, 2011 and claims the benefit thereof. The International Application claims the benefit of German Application No. 102010006216.2 filed on Jan. 29, 2010 and German Application No. 102010014319.7 filed on Apr. 9, 2010, all three applications are incorporated by reference herein in their entirety.

BACKGROUND

Described below is an attenuating mass for an ultrasonic sensor and the use of the attenuating mass.

All kinds of measuring methods exist for measuring the fill level in fluids, each having specific advantages and disadvantages. A robust and versatile measuring method involves measuring using ultrasound, in which the run time of an ultrasonic pulse is measured from the emitter to a boundary surface (e.g. the boundary surface fluid-air) and back to a receiver and the course is calculated from the known or currently determined sound velocity in the medium.

In many instances the same element generating the ultrasound, in most cases a piezoelectric converter, is used both as a transmitter and also as a receiver. The course which can be minimally measured with such a sensor (also known as blocking distance) is determined by how quickly the transmit and receive element comes to rest again after emitting the measuring pulses, so that the echo signal can be clearly detected.

This fading time is influenced by two main factors: on the one hand the acoustic coupling to the measuring medium, on the other hand the mechanical attenuation of the element. A good coupling to the medium shortens the fading time such that a large part of the sound energy can be radiated and does not have to be dissipated in the transmit element by inner friction or other loss mechanisms. Mechanical attenuation of the element destroys or dispels the residual energy in the attenuating material, so that the element itself comes to rest more quickly. It should be noted here that excessive mechanical attenuation can also negatively affect the signal amplitude and the sensitivity of the sound detection.

When used in vehicles, particularly when measuring the oil level in the oil pan of a combustion engine, it is in most cases requested that the blocking distance and thus the minimal detectable oil level be kept as low as possible. To this end, it is necessary to significantly attenuate the fading time of the transmit and receive element, wherein this attenuation has to function across a very wide temperature range.

Interfering signals which are produced from a reflection on the rear side of the sensor, develop due to the pulse/echo method introduced, particularly in the event of inadequate attenuation. In order to suppress these unwanted signals, the rear side of the ultrasonic source is provided with an attenuating mass. Casting compounds which are filled into the plastic housing are used here.

DE 3431741 A1 discloses an apparatus and a method for measuring the fill level of liquids, wherein in closed containers, an ultrasonic sensor which is applied from the outside is coupled in a planar fashion to the flat or curved container base by way of a medium. An epoxy resin adhesive may be used as a medium.

No casting compounds were however known up to now which indicate the required ultrasonic attenuation above a required temperature range of −40° C. to 180° C.

SUMMARY

It is therefore desirable to obtain a casting compound for attenuating ultrasonic sensors in the temperature range of −30 to 150° C.

Accordingly, described below is an attenuating mass, which is soft and stable in a temperature interval of −30° C. to 150° C., including an epoxy resin and a filler, wherein the filler exists in a multimodal grain size distribution, so that a density gradient of the particle exists in the resin matrix. In addition, the use of the attenuating mass in an ultrasonic sensor is described.

According to an advantageous embodiment, the stable epoxy resin up to a temperature of 150° C. or higher has a low glass transition temperature below room temperature, in particular below 0° C., or below (minus) −10° C., or below (minus) −20° C. and in particular at (minus) −35° C.

It was discovered that epoxy resins with acidic, in other words either Lewis acid or Brønsted acid, functional groups, in particular with acid ester groups, have a higher glass transition temperature.

"Half-esters" are referred to as "acidic esters", which form an integral part of an epoxy resin mixture, both of which have functionalities, in other words ester and carboxylic acid, on a molecule. These components are generated for instance by a pre-reaction and are used in turn for instance in the epoxy system plus anhydride as reactive flexibilizing components. A long-chain and flexible dicarboxylic acid can therefore be generated for instance, which is used as a hardening agent component.

According to an advantageous embodiment, the epoxy resin includes a component with an "acidic ester" as a flexibilizing component. It is particularly desired here for the flexibilizing component in a two-component epoxy resin to exist both in the A component, in other words for instance in the epoxy component, and also in the B component, in other words for instance in the anhydride component.

With the presence of "acidic esters" in the case of two components in an epoxy resin, a molding material, which is rubbery-elastic, typically results after hardening the mixture of A and B. For instance, these epoxy resins also have a wide temperature range of for instance 100° C. or more, as shown in the example of Epoxonic 251, in other words from −40° C. to 150° C., with mechanical attenuation.

After hardening, the mixture of A and B results therefrom.

All unfilled flexible up to highly flexible, low-stress epoxy resins, which are low viscose, are suitable. For instance, a viscosity of the epoxy resin at 25° C. of approx 4000 to 9000 mPas, in particular of 5000 to 8500 mPAs and in particular an epoxy resin with a viscosity of 7000+/−1500 mPas are used.

It is desired that the resin has a continuous temperature stability at 120° C. to 190° C., or at least 140° C. to 180° C., and in particular at 150° C.

The hardness of the epoxy resin used is to lie between 20 to 70 Shore A at 25° C., desirably between 30 and 50 Shore A and in particular between 35 to 45 Shore A.

A high density of the resin is very generally sought, because a rear side attenuation is achieved. This is particularly the case when signals are to be prevented, which are irradiated from the ultrasonic source (generally a ceramic with high density) in the unwanted direction, then reflected and finally run in the desired direction and thus interfere with the actual measuring signal.

The density of the filled epoxy resin is to lie at approx 0.8 to 1.8 g/cm$^3$, desirably at 1.0 to 1.5 g/cm$^3$ and particularly at 1.1 g/cm$^3$. The density of the epoxy resin is adjusted with the filler, so that the desired attenuation is achieved. The density of the attenuating mass in other words of the filled epoxy resin lies at 1.5 to 4 g/cm$^3$, desirably at 2.0 to 3.0 g/cm$^3$ and in particular at 2.5 g/cm$^3$, so that the density of the attenuating material is adjusted optimally to the density of the ultrasonic source.

The hardening should be effected approximately after 1 hour at 150° C. The hardening of the epoxy resin initially takes place after filling the resin, so that during the hardening process, the sedimentation of the filler takes place and the desired density gradient within the resin matrix is generated.

The epoxy resin may have a mass loss of less than 15% after 1500 H at 150° C., or even less than 12% and particularly less than 10%.

According to an embodiment, the epoxy resin has an ultimate elongation at 25° C. in the range of 80 to 120%, desirably from 90 to 110% and most desirably approx 100%.

The use of a commercially available epoxy resin which is available under the name Epoxonic® 251 is particularly advantageous.

With mixtures that include glycsidyl ethers and cycloaliphatic epoxides, reference is made to possible carcinogenicity, therefore mixtures of this type are not desired.

An oxide may be used as a filler, particularly an aluminum oxide or a titanium oxide. In particular, a granulated filler has been preserved in order to increase the density of the attenuating mass.

The grain size distribution is arbitrary, wherein according to an advantageous embodiment, the grain size distribution is in the order of magnitude of the wavelength, so that in addition to the attenuation, scattering is also achieved.

Exemplary embodiments are described in more detail below:

| Epoxy resin formulation | | | |
|---|---|---|---|
| EP14 | Gram | MT | 27.000 |
| Epoxonic 251 Part A | 15.517 | 17.241 | 17.24% |
| Epoxonic 251 Part B | 11.483 | 12.759 | 12.76% |
| $Al_2O_3$ F332 (80 μm) | 63.000 | 70.00 | 70.00% |
| Filler having same 2-component volume portion | | | |
| | Gram | MT | 100 |
| EP 25 A1 | | | |
| Epoxonic 251 Part A | 17.241 | 17.241 | 30.00% |
| $Al_2O_3$ F320 (392 μm) | 13.410 | 13.410 | 23.33% |
| $Al_2O_3$ F332 (80μ) | 13.410 | 13.410 | 23.33% |
| $Al_2O_3$ F316 (2.6 μm) | 13.410 | 13.41 | 23.33% |
| | 57.471 | 57.47 | 100.00% |
| EP 25 B1 | | | |
| Epoxonic 251 Part B | 12.759 | 12.759 | 30.00% |
| $Al_2O_3$ F320 (392 μm) | 9.923 | 9.923 | 23.33% |
| $Al_2O_3$ F332 (80 μm) | 9.923 | 9.923 | 23.33% |
| $Al_2O_3$ F316 (2.6 μm) | 9.923 | 9.92 | 23.33% |
| | 42.529 | 42.53 | 100.00% |

Granulated aluminum oxide is added to the epoxy resin as a filler, in order to increase the density of the attenuating mass. The filler particles have a grain size distribution which ensures sedimentation of the particle in the resin matrix during the hardening process. To this end, mixtures of different grain size distributions are also used.

The addition of silicon elastomer particles is not necessary since the reaction resin only becomes brittle at a low temperature, and is otherwise rubbery-elastic and therefore does not require any additional impact modification.

BRIEF DESCRIPTION OF THE DRAWINGS

These and other aspects and advantages will become more apparent and more readily appreciated from the following description of the exemplary embodiments, taken in conjunction with the accompanying drawing of which:

The single FIGURE shows a schematic representation of the structure of the ultrasonic sensor.

DETAILED DESCRIPTION OF THE PREFERRED EMBODIMENT

Reference will now be made in detail to the preferred embodiments, examples of which are illustrated in the accompanying drawings, wherein like reference numerals refer to like elements throughout.

An immersion pipe 1, made of steel for instance, is visible. This immersion pipe 1 immerses, as the name already suggests, into the liquid to be measured, in other words the oil for instance. The corrugated line 2 here indicates the oil level. As a reference signal for the signal delay time, the immersion pipe 1 has two notches 3 at the same height in the immersion pipe 1. The immersion pipe 1 rests on a plastic housing 4, which is made for instance of PA 66, GF30, PA 6, PBT, PET, PPS, PSU and PES for instance with 30% glass fibers.

Arranged centrally in the housing 4 is a carrier 7, on which the attenuating mass 6 rests. The ultrasonic transmitter 5 is on the attenuating mass 6, the ultrasonic transmitter measuring the signal by way of which run time the height of the fill level 2 can be calculated.

In order to achieve the desired attenuation, the ultrasonic signal is initially injected. This is achieved by selecting the filler, which on the one hand increases the density to values of 1.5 to 4 g/cm$^3$ and at the same time as the sedimentation generates a density gradient above the fill height. In addition to mechanical attenuation, scatters can also be achieved with a grain size distribution which lies in the order of magnitude of the wavelength.

The feature of a mechanical attenuation, which extends beyond the overall temperature range, solves the problem of temperature-dependent attenuation.

The attenuating mass described above exhibits a temperature stability in the temperatures prevailing in the motor and the softness and stability that is required across the entire temperature range, in other words ability to attenuate. An attenuating mass is firstly available with a broad temperature interval of this type, which enables continuous use at temperatures of approximately 150° C. and at the same time has very good ultrasonic attenuation at low temperatures.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. An attenuating mass adapted to be soft and stable in a temperature interval of −30° C. to 150° C., comprising:

an epoxy resin matrix; and a filler with a multimodal grain size distribution, wherein the filler is dispersed throughout the resin matrix to cause a density gradient of particles.

2. The attenuating mass as claimed in claim 1, wherein the epoxy resin matrix is adapted to have a glass transition temperature below 0° C.

3. The attenuating mass as claimed in claim 2, wherein the epoxy resin matrix is adapted to have a viscosity at 25° C. of approximately 4000 to 9000 mPAS.

4. The attenuating mass as claimed in claim 3, wherein the attenuating mass has a density increased by the filler to 1.5 to 4 g/cm$^3$.

5. The attenuating mass as claimed in claim 4, wherein the epoxy resin matrix has acidic functional groups.

6. The attenuating mass as claimed in claim 4, wherein the epoxy resin matrix has ester groups.

7. An ultrasonic sensor, comprising:

an ultrasonic transmitter; and an attenuating mass adapted to be soft and stable a temperature interval of −30'C to 150° C. and including an epoxy resin matrix and a filler with a multimodal grain size distribution, wherein the filler is dispersed throughout the resin matrix to cause a density gradient of particles.

8. The ultrasonic sensor as claimed in claim 7, wherein the epoxy resin matrix is adapted to have a glass transition temperature below 0° C.

9. The ultrasonic sensor as claimed in claim 8, wherein the epoxy resin matrix is adapted to have a viscosity at 25° C. of approximately 4000 to 9000 mPAS.

10. The ultrasonic sensor as claimed in claim 9, wherein the attenuating mass has a density increased by the filler to 1.5 to 4 g/cm$^3$.

11. The ultrasonic sensor as claimed in claim 10, wherein the epoxy resin matrix has acidic functional groups.

12. The ultrasonic sensor as claimed in claim 10, wherein the epoxy resin matrix has ester groups.

* * * * *